US007059479B2

(12) United States Patent
Krahl

(10) Patent No.: US 7,059,479 B2
(45) Date of Patent: Jun. 13, 2006

(54) APPARATUS FOR SORTING PILLS

(75) Inventor: Wolfgang Krahl, Laupheim (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 172 days.

(21) Appl. No.: 10/660,372

(22) Filed: Sep. 11, 2003

(65) Prior Publication Data

US 2004/0159594 A1 Aug. 19, 2004

(30) Foreign Application Priority Data

Sep. 12, 2002 (DE) ..... 102 42 243

(51) Int. Cl.
*B07C 5/02* (2006.01)

(52) U.S. Cl. ..... 209/540; 209/682

(58) Field of Classification Search ..... 209/264, 209/660, 682, 683, 540, 544; 198/389
See application file for complete search history.

(56) References Cited

U.S. PATENT DOCUMENTS

| | | | | |
|---|---|---|---|---|
| 920,972 | A * | 5/1909 | Matthewson | 209/398 |
| 1,189,167 | A | 6/1916 | Parker | |
| 2,510,403 | A | 3/1950 | McKinsey | |
| 3,455,445 | A * | 7/1969 | Allen et al. | 209/544 |
| 3,502,193 | A * | 3/1970 | Casmir | 198/389 |
| 3,738,465 | A * | 6/1973 | Ettlinger et al. | 209/540 |
| 4,150,751 | A | 4/1979 | Romagnoli | |
| 4,182,030 | A * | 1/1980 | Mullins | 29/753 |
| 4,223,751 | A | 9/1980 | Ayers | |
| 4,640,407 | A * | 2/1987 | Widener et al. | 198/389 |
| 5,238,124 | A | 8/1993 | Cane | |
| 6,112,906 | A * | 9/2000 | Worsham | 209/678 |

FOREIGN PATENT DOCUMENTS

| | | |
|---|---|---|
| DE | 3317688 | 5/1984 |
| DE | 341489 | 2/1985 |
| EP | 0518058 | 12/1992 |
| WO | WO-93/01006 | 1/1993 |

* cited by examiner

*Primary Examiner*—Joseph C. Rodriguez
(74) *Attorney, Agent, or Firm*—Andrew Wilford

(57) ABSTRACT

An apparatus for sorting small cylindrical objects has a trough having a longitudinally extending groove along which the objects can slide. The groove is of generally rectangular upwardly open shape and has a pair of upright and horizontally spaced side walls and an upwardly directed floor bridging lower edges of the side walls. The floor is formed offset from the side walls with a vertically through-going slot of a width substantially smaller than a predetermined minimum object width so that if any of the objects is of a diameter smaller than the minimum object width it will fall through the slot as it slides along the floor. One of the side walls is formed at the slot with an inwardly directed braking formation engageable with the objects as they slide past the slot to rotate same about vertical axes.

10 Claims, 4 Drawing Sheets

APPARATUS FOR SORTING PILLS

FIELD OF THE INVENTION

The present invention relates to apparatus for sorting small products. More particularly this invention concerns an apparatus for sorting small objects such as pills, capsules, and the like to cull out undersized objects.

BACKGROUND OF THE INVENTION

In the production of small objects like pills, capsules, and the like it is necessary to cull out those objects that are undersized. This can be done by visual inspection or weighing, but such a procedure is not adapted to a production line that may be producing thousands of the objects per hour.

Thus, for example, U.S. Pat. No. 4,223,751 proposes a system where the objects are separated and fed pneumatically, one at a time, in a tube through a capacitive weighing system. Those objects that are below the weight threshold are deflected into a cull bin as they are blown out of the conveying tube.

Such an arrangement is highly effective and can operate very quickly. It has, however, the considerable disadvantage that the objects are handled very roughly. This is fine for a durable small object like a gel cap or capsule, but when applied to a pressed tablet or pill can actually chip and damage the product.

OBJECTS OF THE INVENTION

It is therefore an object of the present invention to provide an improved apparatus for sorting small objects.

Another object is the provision of such an improved apparatus for sorting small objects which overcomes the above-given disadvantages, that is which can determine which of the objects are undersized and can separate out these undersized objects.

A further object is to provide such an apparatus which is extremely simple and that handles the objects fairly gently.

SUMMARY OF THE INVENTION

An apparatus for sorting small objects has according to the invention a trough having a longitudinally extending groove along which the objects can slide. The groove has a floor formed with a throughgoing slot of a width substantially smaller than a predetermined minimum object width so that if any of the objects is of a width smaller than the minimum object width it will fall through the slot as it slides along the floor.

The instant invention therefore uses a purely mechanical system that accurately determines which of the objects are undersized and culls them out. The undersized objects will all fall through the cull slot. The trough can be integrated in the feed mechanism of a packing system or the like so as automatically to remove undersized objects. It lacks any complex electronic parts or sensors so is relatively inexpensive to make and use.

Preferably according to the invention the slot is centrally formed in the groove. Thus objects of full size will be supported to both sides of the cull slot as they pass it. In addition the slot is elongated longitudinally of the groove and normally has a length equal to several times the maximum diameter or size of the objects being sorted so that they have ample time, if undersized, to fall through the cull slot.

When used with biconvex objects the floor can be V-shaped, that is formed of two flat surfaces meeting centrally. Such a shape ensures that biconvex objects are centered in the groove as they slide along it.

In order to ensure that objects missing only a small portion of their periphery are culled out, the groove has a formation that engages and rotates the objects about vertical axes as the objects slide past the slot. Thus, for example, a cylindrical pill sliding on one of its faces along the groove and missing only a chip in one side, will be rotated so that it will loose support at the slot and fall through it. The formation can be a simple roughening on the groove side wall or on its floor near the side wall so that the pill frictionally engages it and is rotated.

When used with pills shaped as short cylinders with planar faces and a cylindrical edge, the groove is of generally rectangular section and has a pair of generally parallel, horizontally spaced, and vertical side walls and an upwardly directed floor bridging lower edges of the side walls and formed with the slot. This slot is offset inward from both of the side walls one of the side walls is formed at the slot with a formation engageable with the objects to rotate same about vertical axes as the objects slide past the slot.

For gravity feed, the trough is inclined to the horizontal. It can also be provided with a vibrator to enhance movement of the objects along the groove.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
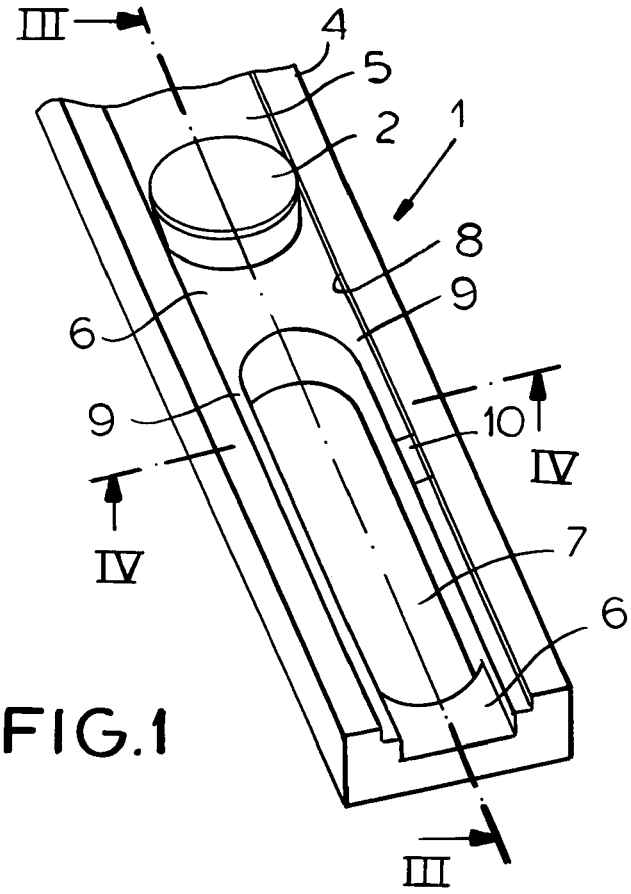
FIG. 1 is a perspective view of the apparatus according to the invention.
Figure 2:
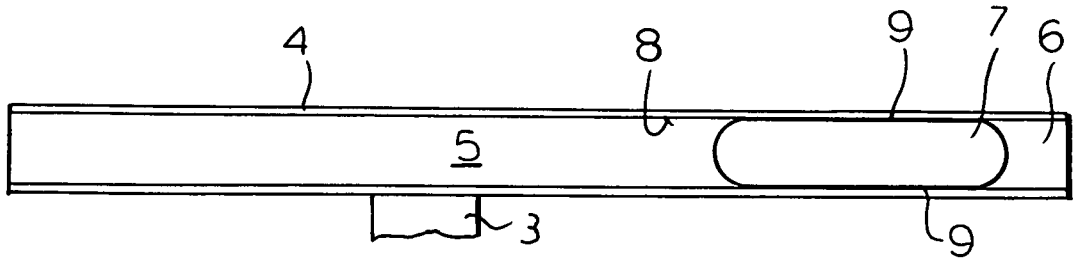
FIG. 2 is a top view of the apparatus.
Figure 3:
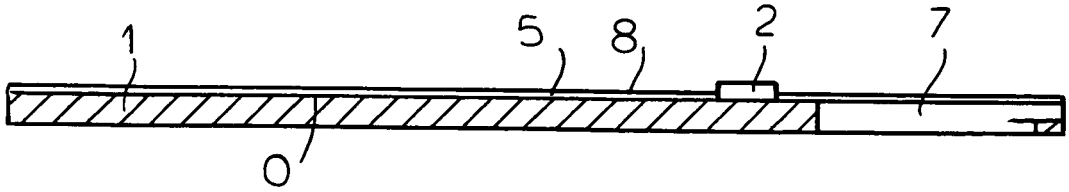
FIG. 3 is a longitudinal section through the apparatus.

As seen in FIGS. 1 through 6 a sorting apparatus 1 basically comprises an elongated channel or trough 4 having a rectangular-section groove 5 with parallel and normally vertical side walls 8 and a planar and upwardly directed floor 6 bridging the lower edges of the walls 8. Objects 2, here pills of short cylindrical shape of which only one is shown, are fed along this groove 5 with their planar and parallel faces directed vertically, their cylindrical edges directed horizontally, and one of their faces riding on the floor 6.

Figure 4:
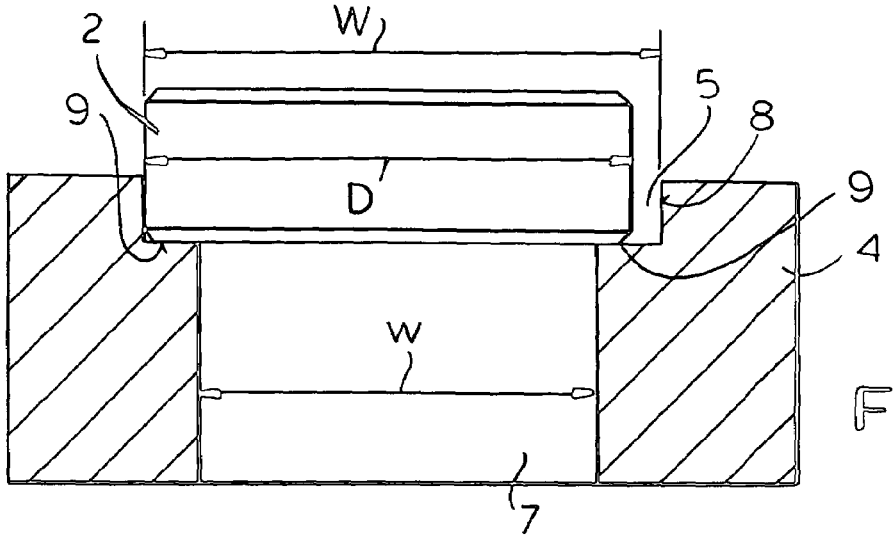
FIG. 4 is a large-scale cross section taken along line IV—IV of FIG. 1.

In accordance with the invention the groove 5 is dimensioned such that the horizontal distance or width W (FIG. 4) between the side walls 8 is slightly more than the diameters D of the pills 2 as shown in FIG. 4, so that the pills 2 can slide easily along the groove 5 resting on the floor 6. The trough 2 is formed centrally with a vertically throughgoing cull slot 7 of a width w measured transverse to the trough 2 that is slightly less than the minimum acceptable width of the pills 2 so as to reduce the floor 6 at the slot 7 to two short shoulder surfaces 9 shown in FIGS. 4–6. This slot 7 has a length equal to substantially more, here almost three times, the diameter D.

Figure 5:
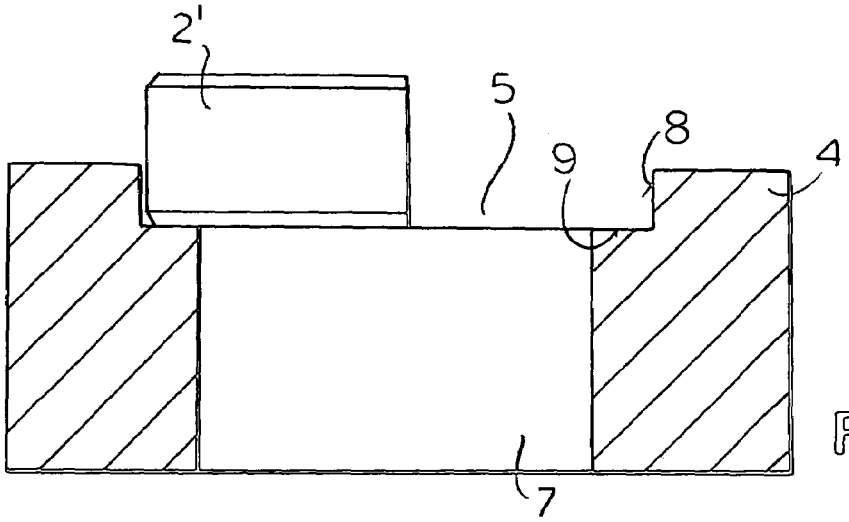
FIG. 5 is a view like FIG. 4 showing an undersized object entering the cull region of the apparatus.
Figure 6:
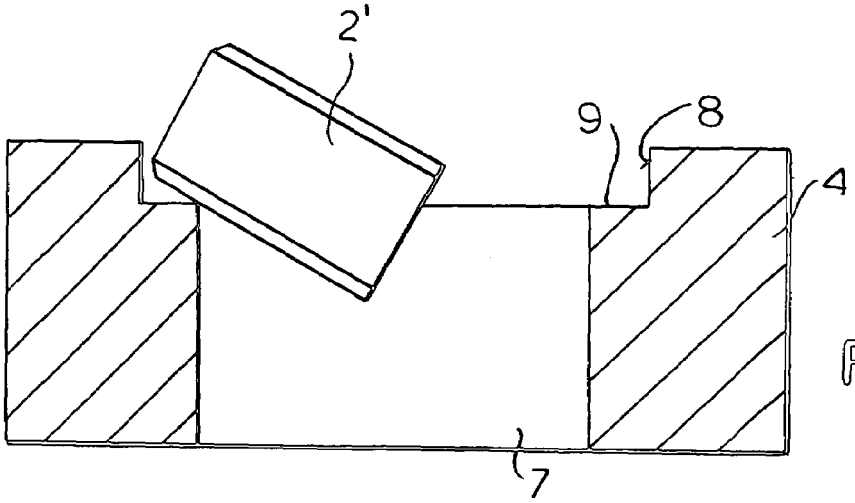
FIG. 6 is a view like FIGS. 4 and 5 showing the undersized object being culled out.
Figure 7:
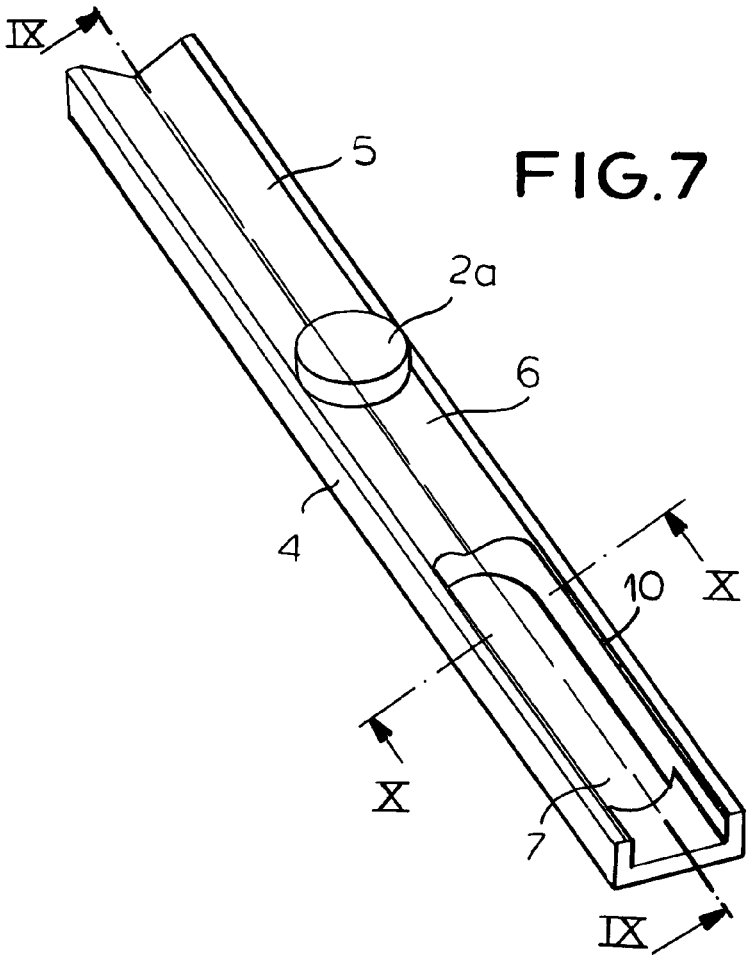
FIG. 7 is a perspective view of another apparatus according to the invention.
Figure 8:
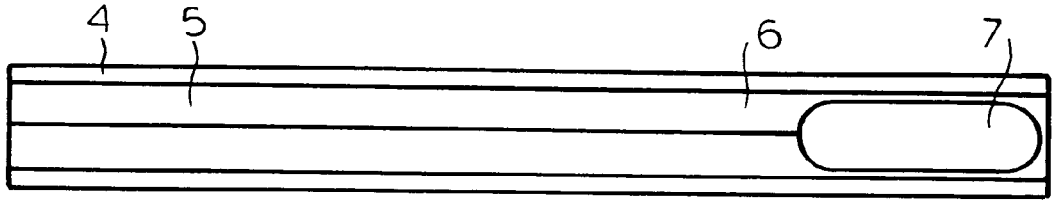
FIG. 8 is a top view of the FIG. 7 apparatus.
Figure 9:
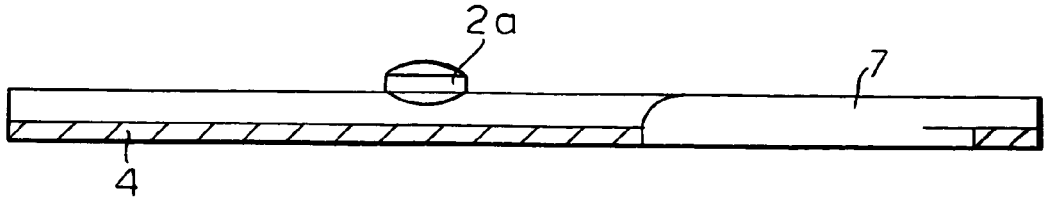
FIG. 9 is a longitudinal section through the apparatus of FIGS. 7 and 8.
Figure 10:
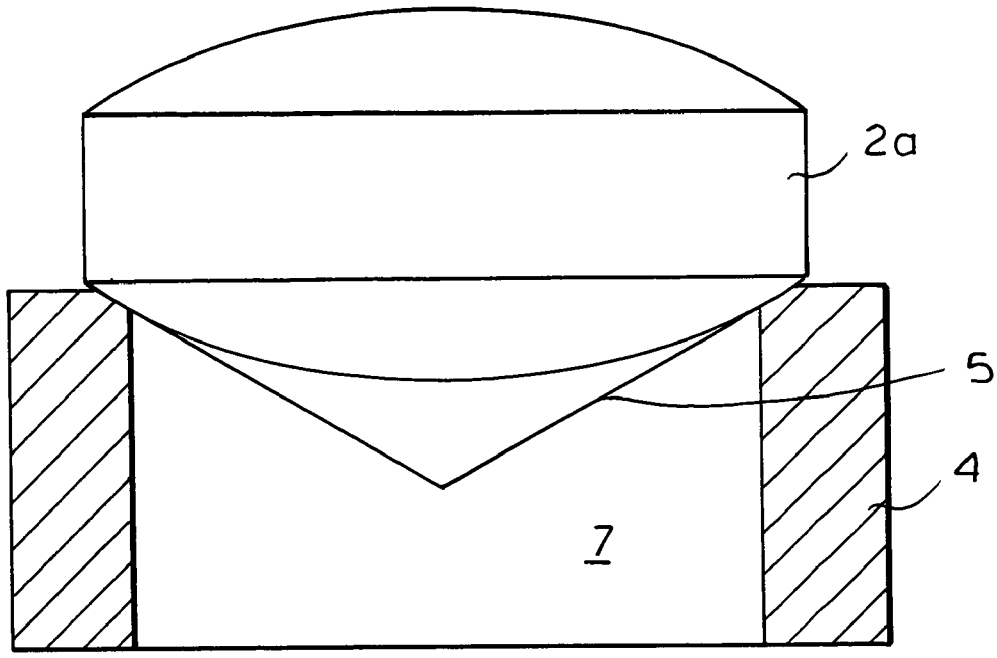
FIG. 10 is a large-scale cross section taken along line X—X of FIG. 7.

Thus if a damaged pill 2', that is one that does not have a full cylindrical shape, reaches the slot 7, it will not be supported on both the shoulders 9 and will drop down into the slot 7 as shown in FIGS. 5 and 6. In this manner undersized pills 2' are culled out. Since the slot 7 is substantially longer than the pill diameter D, even a rapidly sliding undersized pill 2' will drop through the slot 7.

In order to ensure that an undersized pill 2' having only a small portion missing is culled out, one of the side walls 8 is provided with a roughened braking surface 10 adjacent the slot 7 so that the pills 2 are rotated about their axes as they pass the slot 7. This ensures that all incomplete pills 2' will drop through the slot 7.

The trough 4 is normally tipped to the horizontal for gravity feed of the pills 2. In addition a vibrator shown schematically at 3 in FIG. 2 can be attached to the trough 4 to ensure that the pills 2 travel smoothly along it.

Figure 11:
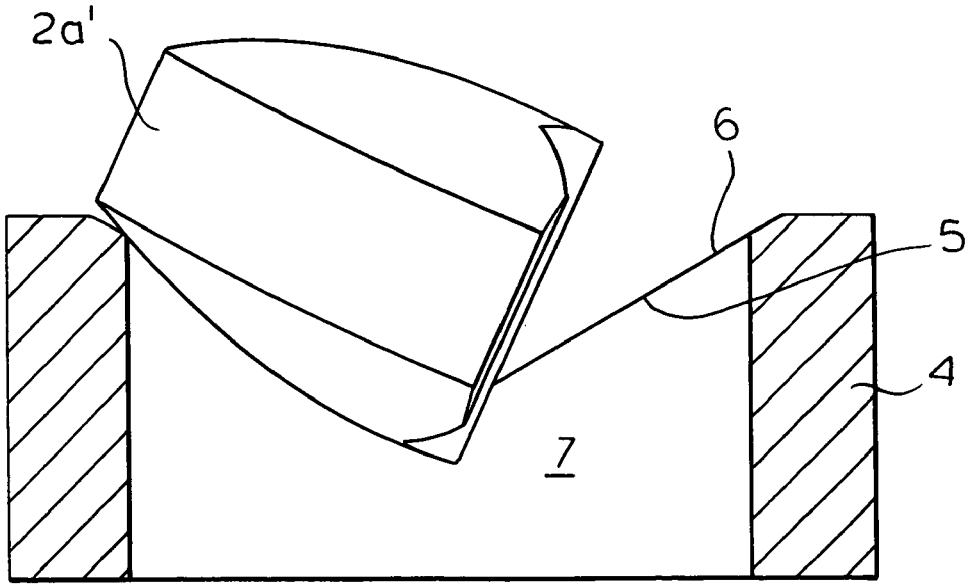
FIG. 11 is a view like FIG. 10 showing an undersized object entering the cull region of the apparatus.

FIGS. 7–11 show an apparatus 1*a* for sorting biconvex pills 2*a*, that is pills 2*a* having part-spherical faces rather than planar ones. Here the trough 4 has a V-shaped floor 6 formed by two planar surfaces along which the biconvex pills 2*a* slide. Otherwise this system is provided with a slot 7 as in FIGS. 1–6 so that incomplete pills 2*a'* are culled out as shown in FIG. 11.

I claim:

1. An apparatus for sorting small objects, the apparatus comprising a trough having a longitudinally extending groove along which the objects can slide, the groove having a floor formed with a throughgoing slot of a width substantially smaller than a predetermined minimum object width, whereby if any of the objects is of a width smaller than the minimum object width it will fall through the slot as it slides along the floor, the floor being formed to one side of the slot with a roughening forming a braking formation that engages and rotates the objects about vertical axes as the objects slide past the slot, the objects engaging the one side with the roughening with greater friction than the other side.

2. The sorting apparatus defined in claim 1 wherein the slot is centrally formed in the groove.

3. The sorting apparatus defined in claim 2 wherein the slot is elongated longitudinally of the groove.

4. The sorting apparatus defined in claim 3 wherein the floor is V-shaped.

5. The sorting apparatus defined in claim 3 wherein the groove is of generally rectangular section and has a pair of generally parallel, horizontally spaced, and vertical side walls and an upwardly directed floor bridging lower edges of the side walls and formed with the slot.

6. The sorting apparatus defined in claim 5 wherein the slot is offset inward from both of the side walls.

7. The sorting apparatus defined in claim 3 wherein the trough is inclined to the horizontal.

8. The sorting apparatus defined in claim 3 wherein the groove is upwardly open.

9. The sorting apparatus defined in claim 3, further comprising means for vibrating the trough.

10. An apparatus for sorting small cylindrical objects, the apparatus comprising a trough having a longitudinally extending groove along which the objects can slide, the groove being of generally rectangular upwardly open shape and having a pair of upright and horizontally spaced side walls and an upwardly directed floor bridging lower edges of the side walls, the floor being formed offset from the side walls with a vertically throughgoing slot of a width substantially smaller than a predetermined minimum object width, whereby if any of the objects is of a diameter smaller than the minimum object width it will fall through the slot as it slides along the floor, one of the side walls being formed at the slot with a roughening forming an inwardly directed braking formation engageable with the objects as they slide past the slot to rotate same about vertical axes, whereby the objects engage the one side with the roughening with greater friction than the other side.

* * * * *